US005322288A

United States Patent [19]

Amis

[11] Patent Number: 5,322,288

[45] Date of Patent: Jun. 21, 1994

[54] GOLF STANCE ALIGNMENT DEVICE

[76] Inventor: James A. Amis, 206 Stanton Ave., Terrace Park, Ohio 45174

[21] Appl. No.: 147,757

[22] Filed: Nov. 5, 1993

[51] Int. Cl.[5] ..... A63B 69/36

[52] U.S. Cl. ..... 273/187 R

[58] Field of Search ..... 273/187 R, 187 A, 187 B, 273/187.1, 195 R, 186.1

[56] References Cited

U.S. PATENT DOCUMENTS

| | | | |
|---|---|---|---|
| 1,517,555 | 12/1924 | Graham | 273/187 R |
| 3,229,981 | 1/1966 | Taber | 273/187 R |
| 3,580,584 | 5/1971 | Trosko | 273/186 |
| 3,658,344 | 4/1972 | Kimble | 273/187 R |
| 3,868,116 | 2/1975 | Ford et al. | 273/186 |
| 3,994,501 | 11/1976 | O'Donnell | 273/187 A |
| 4,257,608 | 3/1981 | Funk | 273/187 R |
| 4,322,084 | 3/1982 | Reece et al. | 273/187 R |
| 4,516,772 | 5/1985 | Stratton | 273/26 R |
| 4,538,815 | 9/1985 | Poirier | 273/187 R |
| 4,699,384 | 10/1987 | Bechler et al. | 273/186 C |
| 4,718,674 | 1/1988 | Henry | 273/186 C |
| 4,962,933 | 10/1990 | Awazu et al. | 273/186 C |
| 5,013,044 | 5/1991 | Hesselbart | 273/186 C |
| 5,014,994 | 5/1991 | Peters | 273/187 R |
| 5,180,168 | 1/1993 | Balestrieri | 273/187 R |
| 5,246,234 | 9/1993 | Zambelli | 273/187 R |

*Primary Examiner*—George J. Marlo
*Attorney, Agent, or Firm*—Ronald W. Kock

[57] ABSTRACT

A golf stance alignment device positioned on the ground between a golfer and a golf ball to be hit with a golf club. The device has a slotted member placed between the golfer's feet pointing toward the golf ball. Connected to the slotted member are a first cross member and a second cross member. The second cross member is adjustable relative to the first cross member in order to accommodate different club lengths and stances. The cross members are held perpendicular to the slotted member by rectangular groove engagement and spring loading between members. Springs hold the cross members engaged with the slotted member when the device is used, but permit disengagement for folding the cross members parallel to the slotted member for compact storage in a special storage tube. The ends of the first cross member are hinged for aiming and storage purposes.

10 Claims, 3 Drawing Sheets

GOLF STANCE ALIGNMENT DEVICE

FIELD OF THE INVENTION

The present invention relates to devices for the improvement of one's golf game, and more particularly to golf stance alignment devices. Even more particularly, the present invention relates to golf stance alignment devices which have aiming features and which are foldable for storage in a golf bag special storage tube.

BACKGROUND OF THE INVENTION

In the teaching of golf and in the practice thereof, one of the most important fundamentals is the alignment of the body to the target to which the golf ball is intended to be hit. Proper foot placement with respect to a line between the golf ball and the target is the key to body alignment. Such foot placement is commonly referred to as a "golf stance".

A number of golf stance indicators and alignment aids have been invented. However, there is a noticeable absence of such devices from the market. This absence is believed due the complexity and cost of earlier inventions and their general lack of convenience.

Prior art golf stance indicators and alignment aids generally lack the ability to be compactly stored as assembled devices in modern golf bags. They typically require disassembly for storage in a golf bag pocket. When used, prior art golf stance indicators must first be reassembly and adjusted, thereby being inconvenient to use.

Many golf stance indicators and alignment aids have construction features which make them prohibitively expensive for mass marketing. They are typically made of metal and have special thumbscrew brackets which enable adjustment. They often have indicia stamped along their lengths to facilitate repeat setups. Some even have electronic feedback systems to indicate body weight shift during the golf swing. While the designs of the more complex indicators and alignment aids suggest that they offer greater accuracy and training benefits their lack of convenience and their overall cost/benefit negatives have resulted in only limited purchase and use by the average golfer.

Some golf stance indicators and alignment aids have golf ball tees built into them. When the golfer miss-hits a ball, the golf club may strike the alignment device. Such devices must be constructed to absorb such abuse without damage. A more convenient and less expensive design locates the golf ball a short distance away from the alignment device so that the ball can either be hit off the grass or off a separate tee, without damaging the alignment device.

The aiming member of almost all prior art golf stance indicators and alignment aids is simply a bar lying on the ground. The golfer is expected to stand above this bar and point it in the direction of the target. This aiming method is no better than merely laying a golf club on the ground pointed in the direction of the target. What is lacking is a sighting feature, such as two vertical members which can be aligned parallel to and coincidental with the target, typically a flagstick on the golf green.

OBJECTS OF THE INVENTION

In light of the above, an object of the present invention is a golf stance alignment device which is inexpensive to manufacture for mass marketing.

A further object of the present invention is a golf stance alignment device that is specifically constructed to be folded for storage in a special golf bag tube as a single device, without the requirement of disassembly into multiple parts which can be lost or misplaced.

Still another object of the present invention is a golf stance alignment device that has at least two vertical members, for accurate target sighting purposes, which can be folded downward to rest on the ground after sighting is completed.

SUMMARY OF THE INVENTION

Modern golf bags either have plastic tubes extending from top to bottom to separate the shafts of a set of golf clubs, or they have ample space to accept, in addition to a set of golf clubs, a special tube for an umbrella, for example. Also, some modern golf bags have straps or other means for holding a golf size umbrella to the outside of the bag. In practicing the present invention, a special storage tube, similar to a golf umbrella tube, is supplied with each golf stance alignment device. The special storage tube is of adequate length that it may be placed randomly among the golf clubs in a golf bag which has no golf club tubes to separate the clubs. In a bag which has golf club tubes to separate the clubs, the special storage tube may be attached to the outside of the golf bag where the golf umbrella is normally attached. By adapting the means for storage of the golf stance alignment device of the present invention to the design of the modern golf bag, convenience of use is improved.

In one preferred embodiment of the present invention, a golf stance alignment device comprises a slotted member positioned on the ground between a golfer's feet. The slotted member has a foot end and a golf ball locating end, and it also has a longitudinal slot therethrough at the foot end and a hole therethrough at the golf ball locating end. The device further comprises a first cross member connected substantially perpendicular to the slotted member at the hole in the slotted member by a first pin. In addition there is a second cross member slidably connected substantially perpendicular to the slotted member at the slot in the slotted member by a second pin. The device also comprises a spring at each of the first and second pins. The springs are compressed to clamp the first and second cross members against the slotted member in order to maintain substantially perpendicular relationships between the members during use of the golf stance alignment device.

In this preferred embodiment the first and second cross members may be rotated for storage such that they are clamped against the slotted member by the springs in a substantially parallel orientation so that the golf stance alignment device may be placed into a special storage tube without disassembly of the device. Also in this preferred embodiment the first cross member may have two hinged ends, both of the hinged ends being rotatable upright, when the golf stance alignment device rests on substantially level ground, to act as sighting posts in order to accurately align the first member with a golf ball target. The two hinged ends of the first cross member may also be rotated such that the two hinged ends are folded back against the first cross member for compact storage of the golf stance alignment device in a special storage tube without disassembly of the device.

In a second preferred embodiment of the present invention, a golf stance alignment device comprises a slotted member having a rectangular cross-section positioned on the ground between a golfer's feet. The slotted member has a foot end and a golf ball locating end, and it also has a longitudinal slot therethrough at the foot end and a hole therethrough at the golf ball locating end. In addition the device has a first cross member having a rectangular groove adapted to engage the rectangular cross-section of the slotted member. The first cross member also has a hole centered in the groove. The first cross member is connected substantially perpendicular to the slotted member by a first pin through the hole in the slotted member and the hole in the first cross member when the slotted member is seated in the groove of the first cross member. The device further comprises a second cross member having a rectangular groove adapted to engage the rectangular cross-section of the slotted member. The second cross member also has a hole centered in the groove. The second cross member is slidably connected substantially perpendicular to the slotted member by a second pin through the slot in the slotted member and the hole in the second cross member when the slotted member is seated in the groove of the second cross member.

The device also comprises a spring at each of the first and second pins. The springs are compressed to clamp the first and second cross members against the slotted member in order to maintain engagement of the slotted member with the grooves of the first and second cross members during use. Also, the springs have sufficient travel remaining before their solid heights are reached to permit disengaging the grooves of the first and second cross members from the slotted member so that all three of the members may be aligned substantially parallel for placement into a special storage tube without disassembly.

In a third preferred embodiment of the present invention, a golf stance alignment device comprises a slotted member having a rectangular cross-section positioned on the ground between a golfer's feet. The slotted member has a foot end and a golf ball locating end, and it also has a longitudinal slot therethrough at the foot end and a hole therethrough at the golf ball locating end. In addition the device has a first cross member having a rectangular groove adapted to engage the rectangular cross-section of the slotted member. The first cross member also has a hole centered in the groove. The first cross member is connected substantially perpendicular to the slotted member by a first pin through the hole in the slotted member and the hole in the first cross member when the slotted member is seated in the groove of the first cross member. The first cross member also has two hinged ends. Both of the hinged ends are rotatable upright, when the golf stance alignment device rests on substantially level ground, to act as sighting posts in order to accurately align the first cross member with a golf ball target. The device further comprises a second cross member having a rectangular groove adapted to engage the rectangular cross-section of the slotted member. The second cross member also has a hole centered in the groove. The second cross member is slidably connected substantially perpendicular to the slotted member by a second pin through the slot in the slotted member and the hole in the second cross member when the slotted member is seated in the groove of the second cross member.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements.

DETAILED DESCRIPTION OF THE INVENTION

Figure 1:
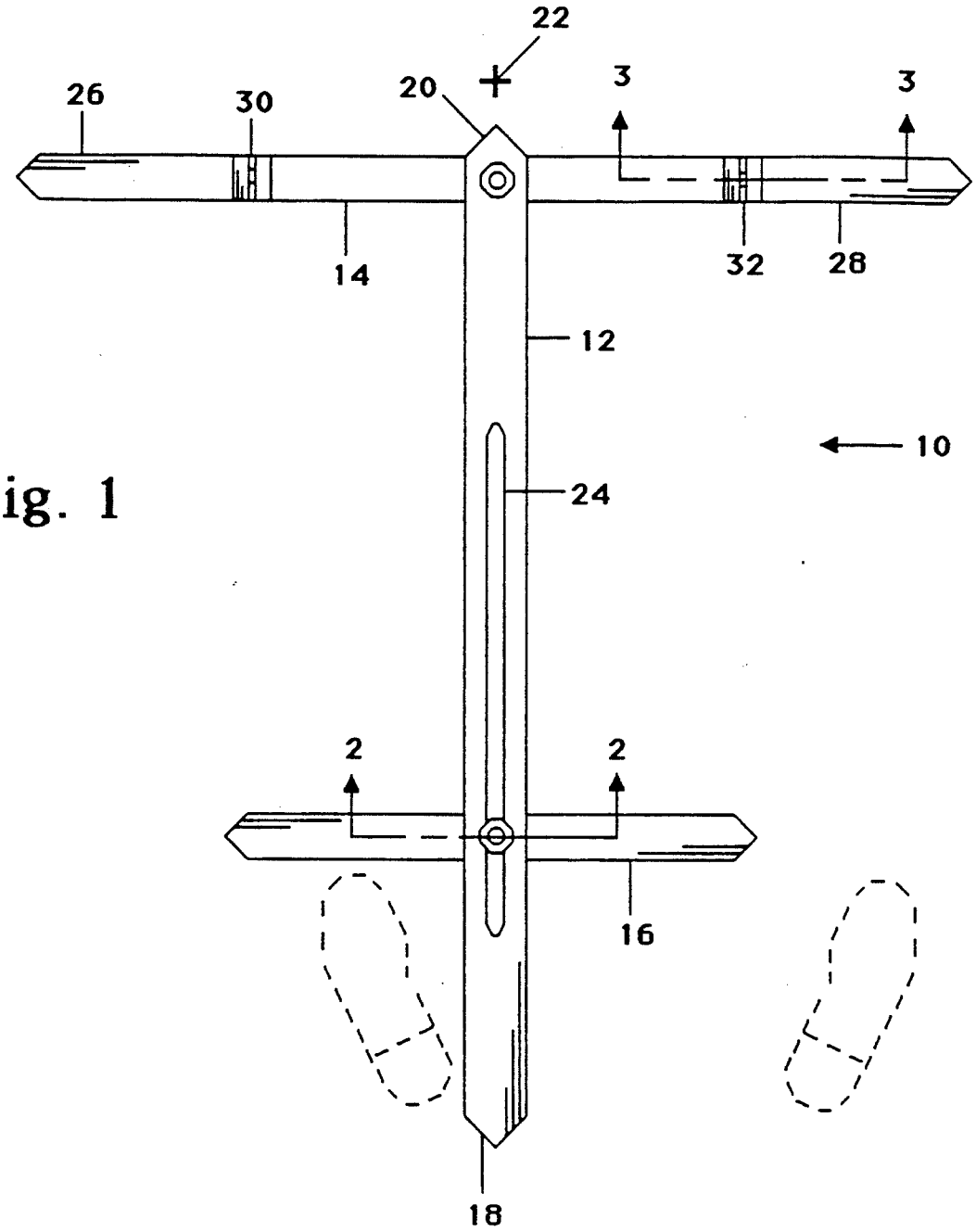
FIG. 1 is a top plan view of a preferred embodiment of the present invention, disclosing a golf stance alignment device and showing a foot stance for a right-handed golfer about to hit a drive.

Referring now to the drawings, and more particularly to FIG. 1, there is shown a first preferred embodiment of the golf stance alignment device of the present invention, generally indicated as 10. Golf stance alignment device 10 has a slotted member 12, first cross member 14, and second cross member 16. Slotted member 12 has foot end 18 and a golf ball locating end 20. Adjacent golf ball locating end 20 is a cross 22, which indicates the proper location of a golf ball to be hit relative to alignment device 10. Cross 22 is in line with slotted member 12 and about 3 to 4 inches beyond golf ball locating end 20. A golf ball at cross 22 may be resting on the ground or placed upon a golf tee.

Slotted member 12 has a slot 24 centered along its length, which extends through slotted member 12 for the purpose of connecting and adjusting second cross member 16. Slot 24 is nearest foot end 18 of slotted member 12. Slotted member 12 also has a hole, not seen, but extending through slotted member 12 and centered in its golf ball locating end 20 for the purpose of connecting first cross member 14.

Figure 3A:
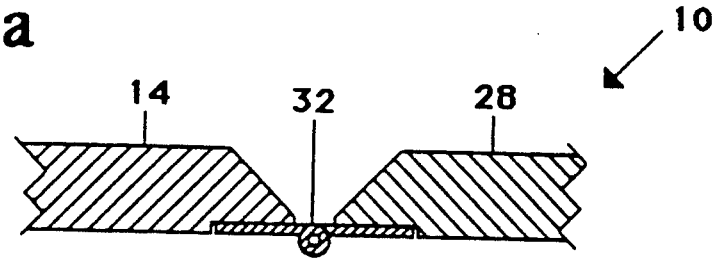
FIG. 3*a* is an enlarged sectioned elevation view, taken along section line 3—3 of FIG. 1, showing a hinged end of a first cross member folded downward against the ground.
Figure 3B:
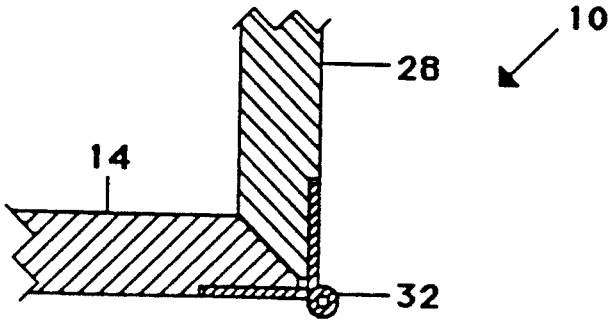
FIG. 3*b* is an enlarged sectioned elevation view, taken along section line 3—3 of FIG. 1, showing a hinged end of a first cross member folded upright for aiming.

First cross member 14 is an aiming member. In use it is substantially perpendicular to slotted member 12, and its length axis ideally points at the target to which a golf ball at cross 22 is to be hit by a golfer swinging a golf club. First cross member 14 has a left hinged end 26 and a right hinged end 28 connected to first cross member 14 by hinges 30 and 32, respectively. The hinged ends 26 and 28 can be lifted upright from their positions shown in FIG. 1 for aiming first member 14 at a flagstick in a golf hole, for example. FIGS. 3*a* and 3*b* show the right hinged end 28 folded down against the ground and folded upright for aiming, respectively. Aiming is improved by the ability of the golfer to lean down and align the two upright ends 26 and 28 with the target such that they are all in the same vertical plane. This is an improvement over conventional aiming, which has the golfer standing above an aiming member, resting on the ground, and looking along its length toward the target. Significant aiming errors may result from the conventional aiming approach when the golfer's eyes are not directly over the aiming member.

Second cross member 16 is a foot position member. In use it is substantially perpendicular to slotted member 12. Second cross member 16 is adjustable in position relative to first cross member 14 by sliding it along slotted member 12. It is necessary to adjust the position of the foot position member when different length clubs are used by the golfer. A longer club demands the feet be placed further from the ball, and therefore second cross member 16 is adjusted further from first cross member 14.

In FIG. 1 dotted lines show the position of a golfer's shoes relative to the golf stance alignment device 10 when the golfer is right handed and using a longer golf club, such as a driver. The slotted member 12 is placed closest to the heel of the golfer's left shoe, with the left toe being just behind the second cross member 16. The slotted member 12 has its foot end 18 extending rearward of second cross member 16 so that the right handed golfer can accurately place his left foot relative to both members 12 and 16.

The right foot of the right handed golfer may be placed just behind the second cross member 16 for a straight golf shot, or it may be moved forward or rearward in order for the golfer to "fade" or "hook" the ball, respectively. These latter terms mean to cause the ball to curve to the right or to the left of their way to the target, as is commonly known by golfers. Thus, the length of second cross member 16 is short enough to permit the right handed golfer to position his right foot without interference from cross member 16. The golf stance alignment device of the present invention is not limited to right handed golfers. A left handed golfer would place the golf stance alignment device such that the foot end 18 of slotted member 12 is near the heel of the right shoe.

Figure 2:
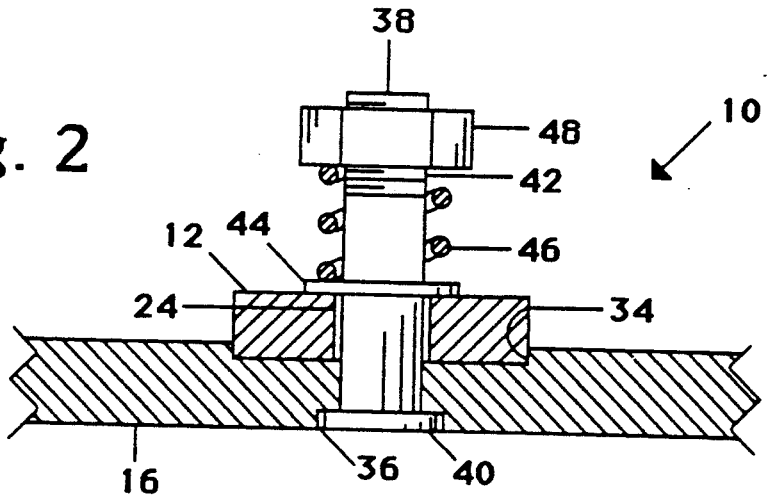
FIG. 2 is an enlarged sectioned elevation view, taken along section line 2—2 of FIG. 1, showing a second cross member engaged with a slotted member at right angles and clamped together by a spring compressed on a threaded pin by a nut.

FIG. 2 shows how the first and second cross members, 14 and 16, are connected to the slotted member 12. Although FIG. 2 is an elevational section view at the connection of the second cross member 16, the view would be identical for the connection of the first cross member 14 to slotted member 12. The cross members and slotted member of golf stance alignment device 10 have rectangular cross-sections approximately equal in size. Second cross member 16 has a rectangular groove 34 which fits the cross-section of slotted member 12 with a slight clearance. The depth of rectangular groove 34 is sufficient to maintain second cross member 16 substantially perpendicular to slotted member 12 when slotted member 12 is engaged by groove 34. However, rectangular groove 34 is shallow enough to avoid substantial weakening of second cross member 16.

Second cross member 16 also has a counterbored hole 36 centered in rectangular slot 34 through which a threaded pin 38, having a flat head 40, may be inserted. Threaded pin 38 extends upright from second cross member 16 and through slot 24 of slotted member 12. Pin 38 has threads 42 extending well above slot 24. Onto pin 38 are placed a washer 44 and a compression spring 46. A special nut 48 is threaded onto threads 42 of pin 38 to compress spring 46 against washer 44, and thereby pull head 40 of pin 38 tightly into counter-bored hole 36. In this way second cross member 16 is clamped against slotted member 12 to prevent slotted member 12 lifting out of rectangular groove 34. Washer 44 helps to prevent an end of spring 46 entering slot 24 and hindering the ability to slide pin 38 along slot 24 for adjustment of second cross member 16 relative to first cross member 14. Special nut 48 is preferably of the type which once threaded into place is difficult to unscrew.

Spring 42 has sufficient travel remaining after it is compressed by nut 48 that slotted member 12 can be manually lifted out of groove 34 before the spring's solid height is reached. Slotted member 12 can then be rotated 90° so that it is clamped parallel to second cross member 16 without groove engagement. Such an arrangement is shown in FIG. 4, and represents the desired cross member alignment for storage of golf stance alignment device 10.

FIG. 3*a* shows first cross member 14 and right hinged end 28 connected by hinge 32. In this position the golf stance alignment device 10 is resting on the ground, and the golfer is about to hit the golf ball. In FIG. 3*b* the hinged end 28 is rotated upright for aiming purposes. Hinge 32 is preferably a commercial metal hinge which is mounted to first cross member 14 and right hinged end 28 by threaded fasteners not shown. Hinge 32 is recessed into the cross member and hinged end so that both members may rest flat on the ground in FIG. 3*a*. The ends of first cross member 14 and hinged end 28 adjoining hinge 32 are preferably beveled 45° away from hinge 32 so that hinged end 28 may be rotated upright but no further. Having hinge 32 on the bottom side of the first cross member and the hinged end 28 enables hinged end 28 to also be rotated approximately 180° downward such that it may be folded back against first cross member 14. The arrangement of left hinged end 26 and hinge 30 to first cross member 14 is identical to that for hinged end 28 and hinge 32.

Figure 4:
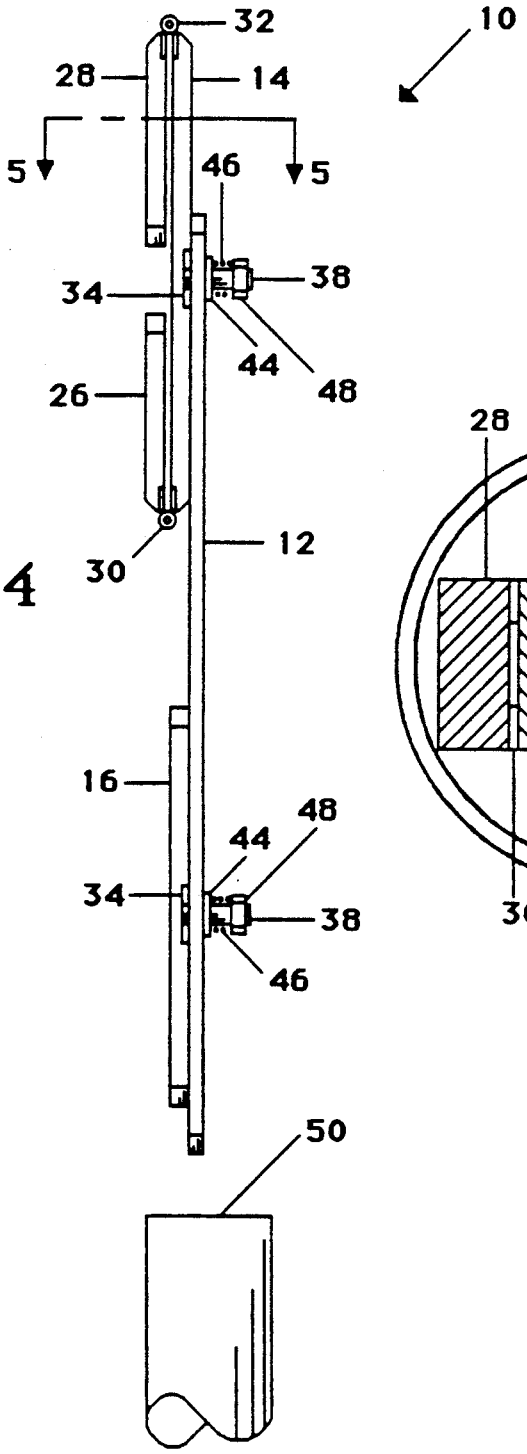
FIG. 4 is a side elevation view of the golf stance alignment device of FIG. 1, showing first and second cross members aligned parallel to a slotted member for compact storage in a special storage tube.
Figure 5:
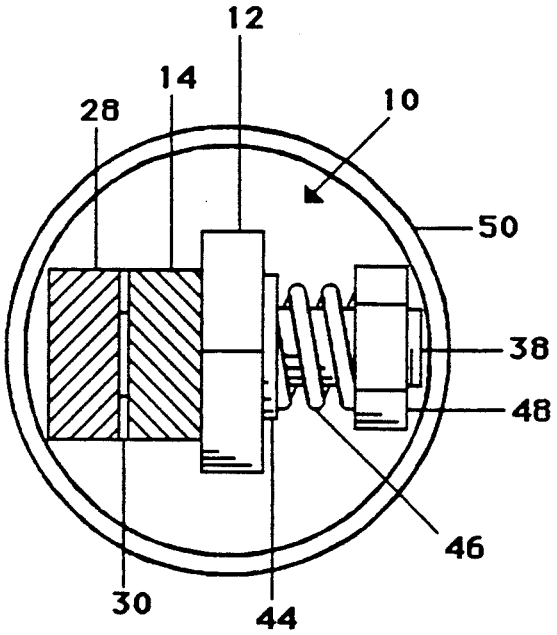
FIG. 5 is an enlarged sectioned elevation view, taken along section line 5—5 of FIG. 4, showing the fit of the golf stance alignment device of FIG. 4 in a special storage tube.

FIG. 4 shows the golf stance alignment device 10 folded for storage. First and second cross members 14 and 16 are parallel to slotted member 12, and hinged ends 26 and 28 are folded against the underside of first cross member 14. Groove 34 of each cross member is shown disengaged from slotted member 12. A special storage tube 50 is shown below foot end 18 of golf stance alignment device 10. FIG. 5 shows how golf stance alignment device 10 fits into the special storage tube 50 in its folded condition.

In a preferred embodiment of the golf stance alignment device of the present invention slotted member 12 is 37 inches long, first cross member 14, including hinged ends, is 24 inches long, and second cross member 16 is 12 inches long. Hinged ends 26 and 28 are each 7 inches long. Each cross member is 0.31 inches thick and 0.75 inches wide. Slotted member is 0.25 inches thick and 1.0 inches wide. Slot 24 is 0.38 inches wide and 18 inches long, starting about 6 inches from foot end 18. Pin 38 is 0.31 inches in diameter and 1.25 inches in length with 5/16-18 threads. Head 40 is 0.06 inches thick and has a diameter of 0.38 inches. Rectangular groove 34 is preferably 0.06 inches deep and 1.02 inches wide. Counterbore 36 in each cross member is preferably 0.06 inches deep and 0.44 inches in diameter, leading to a 0.32 inch diameter clearance hole for pin 38. Spring 46 has a 0.38 inch free length and an inside diameter of 0.38 inches with 2 full coils of 16 gage music wire. End coils of spring 46 are squared and ground. Washer 44 is a standard 5/16 inch flat washer. Nut 48 is a 3/16 inch thick, 5/16–18 threaded hex nut with threads designed for resistance to unthreading. A special storage tube has an inside diameter of 1.75 inches. The pins, nuts, washers and springs are all made of plated steel and the members are made of a high strength, impact resistant plastic, such as glass-filled nylon.

It is thought that the golf stance alignment device of the present invention, and many of its attendant advantages, will be understood from the foregoing description; and it will be apparent that various changes may be made in form, construction, and arrangement without departing from the spirit and scope of the invention or sacrificing all of its material advantages, the forms hereinbefore described being merely preferred or exemplary embodiments thereof.

What is claimed is:

1. A golf stance alignment device comprising:

a) a slotted member positioned on the ground between a golfer's feet, said slotted member having a foot end and a golf ball locating end, said slotted member also having a longitudinal slot therethrough at said foot end and a hole therethrough at said golf ball locating end;

b) a first cross member connected substantially perpendicular to said slotted member at said hole in said slotted member by a first pin;

c) a second cross member slidably connected substantially perpendicular to said slotted member at said slot in said slotted member by a second pin; and d) a spring at each of said first and second pins, said springs compressed to clamp said first and second cross members against said slotted member in order to maintain substantially perpendicular relationships between said members during use of said golf stance alignment device.

2. The golf stance alignment device of claim 1 wherein said first and second cross members may be rotated such that they are clamped against said slotted member by said springs in a substantially parallel orientation so that said golf stance alignment device may be placed into a special storage tube without disassembly of said device.

3. The golf stance alignment device of claim 1 wherein said first cross member has two hinged ends, both of said hinged ends being rotatable upright, when said golf stance alignment device rests on substantially level ground, to act as sighting posts in order to accurately align said first member with a golf ball target.

4. The golf stance alignment device of claim 3 wherein said two hinged ends of said first cross member may also be rotated such that said two hinged ends are folded back against said first cross member for compact storage of said golf stance alignment device in a special storage tube without disassembly of said device.

5. A golf stance alignment device comprising:

a) a slotted member having a rectangular cross-section positioned on the ground between a golfer's feet, said slotted member having a foot end and a golf ball locating end, said slotted member also having a longitudinal slot therethrough at said foot end and a hole therethrough at said golf ball locating end;

b) a first cross member having a rectangular groove adapted to engage said rectangular cross-section of said slotted member, said first cross member also having a hole centered in said groove, said first cross member connected substantially perpendicular to said slotted member by a first pin through said hole in said slotted member and said hole in said first cross member when said slotted member is seated in said rectangular groove of said first cross member;

c) a second cross member having a rectangular groove adapted to engage said rectangular cross-section of said slotted member, said second cross member also having a hole centered in said groove, said second cross member slidably connected substantially perpendicular to said slotted member by a second pin through said slot in said slotted member and said hole in said second cross member when said slotted member is seated in said rectangular groove of said second cross member; and d) a spring at each of said first and second pins, said springs compressed to clamp said first and second cross members against said slotted member in order to maintain engagement of said slotted member with said rectangular grooves of said first and second cross members during use, said springs having sufficient travel remaining before their solid heights are reached to permit disengaging said rectangular grooves of said first and second cross members from said slotted member so that all three of said members may be aligned substantially parallel for placement into a special storage tube without disassembly.

6. The golf stance alignment device of claim 5 wherein said first cross member has two hinged ends, both of said hinged ends being rotatable upright, when said golf stance alignment device rests on substantially level ground, to act as sighting posts in order to accurately align said first member with a golf ball target.

7. The golf stance alignment device of claim 6 wherein said two hinged ends of said first cross member may also be rotated such that said two hinged ends are folded back against said first cross member for more compact storage of said golf stance alignment device in a special storage tube without disassembly of said device.

8. A golf stance alignment device comprising:

a) a slotted member having a rectangular cross-section positioned on the ground between a golfer's feet, said slotted member having a foot end and a golf ball locating end, said slotted member also having a longitudinal slot therethrough at said foot end and a hole therethrough at said golf ball locating end;

b) a first cross member having a rectangular groove adapted to engage said rectangular cross-section of said slotted member, said first cross member also having a hole centered in said rectangular groove, said first cross member connected substantially perpendicular to said slotted member by a first pin through said hole in said slotted member and said hole in said first cross member when said slotted member is seated in said rectangular groove of said first cross member, said first member also having two hinged ends, both of said hinged ends being rotatable upright, when said golf stance alignment device rests on substantially level ground, to act as sighting posts in order to accurately align said first member with a golf ball target; and c) a second cross member having a rectangular groove adapted to engage said rectangular cross-section of said slotted member, said second cross member also having a hole centered in said rectangular groove, said second cross member slidably connected substantially perpendicular to said slotted member by a second pin through said slot in said slotted member and said hole in said second cross member when said slotted member is seated in said rectangular groove of said second cross member.

9. The golf stance alignment device of claim 8 further comprising a spring at each of said first and second pins, said springs compressed to clamp said first and second cross members against said slotted member in order to maintain engagement of said slotted member with said rectangular grooves of said first and second cross members during use, said springs having sufficient travel remaining before their solid heights are reached to permit disengaging said rectangular grooves of said first and second cross members from said slotted member so that all three of said members may be aligned substantially parallel for placement into a special storage tube without disassembly.

10. The golf stance alignment device of claim 8 wherein said two hinged ends of said first cross member may also be rotated such that said two hinged ends are folded back against said first cross member for more compact storage of said golf stance alignment device in a special storage tube without disassembly of said device.

* * * * *